US011939985B2

(12) United States Patent
He et al.

(10) Patent No.: US 11,939,985 B2
(45) Date of Patent: Mar. 26, 2024

(54) CONTROL CIRCUIT FOR MOTOR POWERED BY STORAGE BATTERY AND FAN

(71) Applicant: JIANGMEN KEYE ELECTRIC APPLIANCES MANUFACTURING CO., LTD, Jiangmen (CN)

(72) Inventors: Xiangming He, Jiangmen (CN); Guanglian Lin, Jiangmen (CN)

(73) Assignee: JIANGMEN KEYE ELECTRIC APPLIANCES MANUFACTURING CO., LTD, Guangdong Province (CN)

( * ) Notice: Subject to any disclaimer, the term of this patent is extended or adjusted under 35 U.S.C. 154(b) by 318 days.

(21) Appl. No.: 17/582,388

(22) Filed: Jan. 24, 2022

(65) Prior Publication Data

US 2023/0087771 A1 Mar. 23, 2023

(30) Foreign Application Priority Data

Sep. 18, 2021 (CN) ..... 202111101368.3

(51) Int. Cl.

| | |
|---|---|
| ***H05K 7/20*** | (2006.01) |
| ***F04D 25/08*** | (2006.01) |
| ***F04D 27/00*** | (2006.01) |
| ***F04D 29/00*** | (2006.01) |

(52) U.S. Cl.

CPC ..... *F04D 25/08* (2013.01); *F04D 27/004* (2013.01); *F04D 29/002* (2013.01)

(58) Field of Classification Search

CPC ..... H02P 23/0004; H02P 23/20; H02P 27/085

See application file for complete search history.

(56) References Cited

U.S. PATENT DOCUMENTS

| | | | | |
|---|---|---|---|---|
| 2007/0183282 | A1* | 8/2007 | Oyabu | H02P 6/06 369/47.25 |
| 2009/0251084 | A1* | 10/2009 | Haas | H02P 1/04 318/400.11 |
| 2018/0358914 | A1* | 12/2018 | Gohara | H02P 27/085 |
| 2019/0299934 | A1* | 10/2019 | Mizuno | H02P 23/04 |

FOREIGN PATENT DOCUMENTS

| | | | |
|---|---|---|---|
| CN | 101803171 | A | 8/2010 |
| CN | 107276214 | A | 10/2017 |
| CN | 108252940 | A | 7/2018 |
| CN | 108880382 | A | 11/2018 |

* cited by examiner

*Primary Examiner* — Muhammad S Islam

(74) *Attorney, Agent, or Firm* — Schmeiser, Olsen & Watts LLP

(57) ABSTRACT

A control circuit including a motor drive unit and a processing control unit is provided. The motor drive unit includes a drive current for a motor according to a modulation signal, and the motor is powered by a storage battery. The processing control unit obtains an actual speed of the motor, calculate the modulation signal by comparing the actual speed and a target speed, and transmit the modulation signal to the motor drive unit. Also, the modulation signal is used to control rotation of the motor by modulating the drive current, so that the actual speed tends to be equal to the target speed.

18 Claims, 7 Drawing Sheets

-- Prior Art --

CONTROL CIRCUIT FOR MOTOR POWERED BY STORAGE BATTERY AND FAN

CROSS REFERENCE TO RELATED APPLICATIONS

This application claims priority to Chinese Application No. CN 202111101368.3 having a filing date of Sep. 18, 2021, the entire contents of which are hereby incorporated by reference.

FIELD OF TECHNOLOGY

The following relates to the technical field of motors, in particular to a control circuit for a motor powered by a storage battery, and a fan with such a control circuit.

BACKGROUND

With the development of rechargeable batteries, i.e., storage batteries, fans powered by storage batteries have gradually come to use. However, due to the voltage drop of the storage battery during discharging, the input voltage of the fan's motor to drop accordingly, which leads to a drop in the rotating speed of the motor. That is, the rotating speed of the fan powered by such storage battery will decline dramatically as the battery voltage declines in use. As shown in FIG. 1, as the fan's use time increases, since the battery voltage gradually decreases, the rotating speed of the fan decreases significantly in a short period of time. The problem that the speed of the fan decreases drastically with the decrease of the battery voltage will have a bad effect on the user's experience of using the fan.

SUMMARY

An aspect relates to a control circuit for a motor powered by a storage battery, which does not make the motor's speed decrease significantly with the decrease of the battery power during use.

The control circuit includes a motor drive unit and a processing control unit. The motor drive unit provides a drive current for the motor according to a modulation signal. The processing control unit obtains an actual speed of the motor, calculate the modulation signal by comparing the actual speed and a target speed, and transmit the modulation signal to the motor drive unit. And the modulation signal is used to control rotation of the motor by modulating the drive current, so that the actual speed tends to be equal to the target speed.

The control circuit can detect the actual speed of the motor in real time, and timely adjust the drive current of the motor according to the difference between the actual speed and the target speed, so as to timely adjust the actual speed of the motor, thereby even when the battery power decreases, the actual speed of the motor can approach the target speed, so the speed of the motor can remain stable.

Another aspect relates to a fan having the above type of control circuit, wherein the drive motor of the fan is controlled by the control circuit and the motor's speed not decrease significantly with the decrease of the battery power during use, so as to ensure the stable wind speed of the fan.

BRIEF DESCRIPTION

Some of the embodiments will be described in detail, with reference to the following figures, wherein like designations denote like members, wherein.

Figure 2:
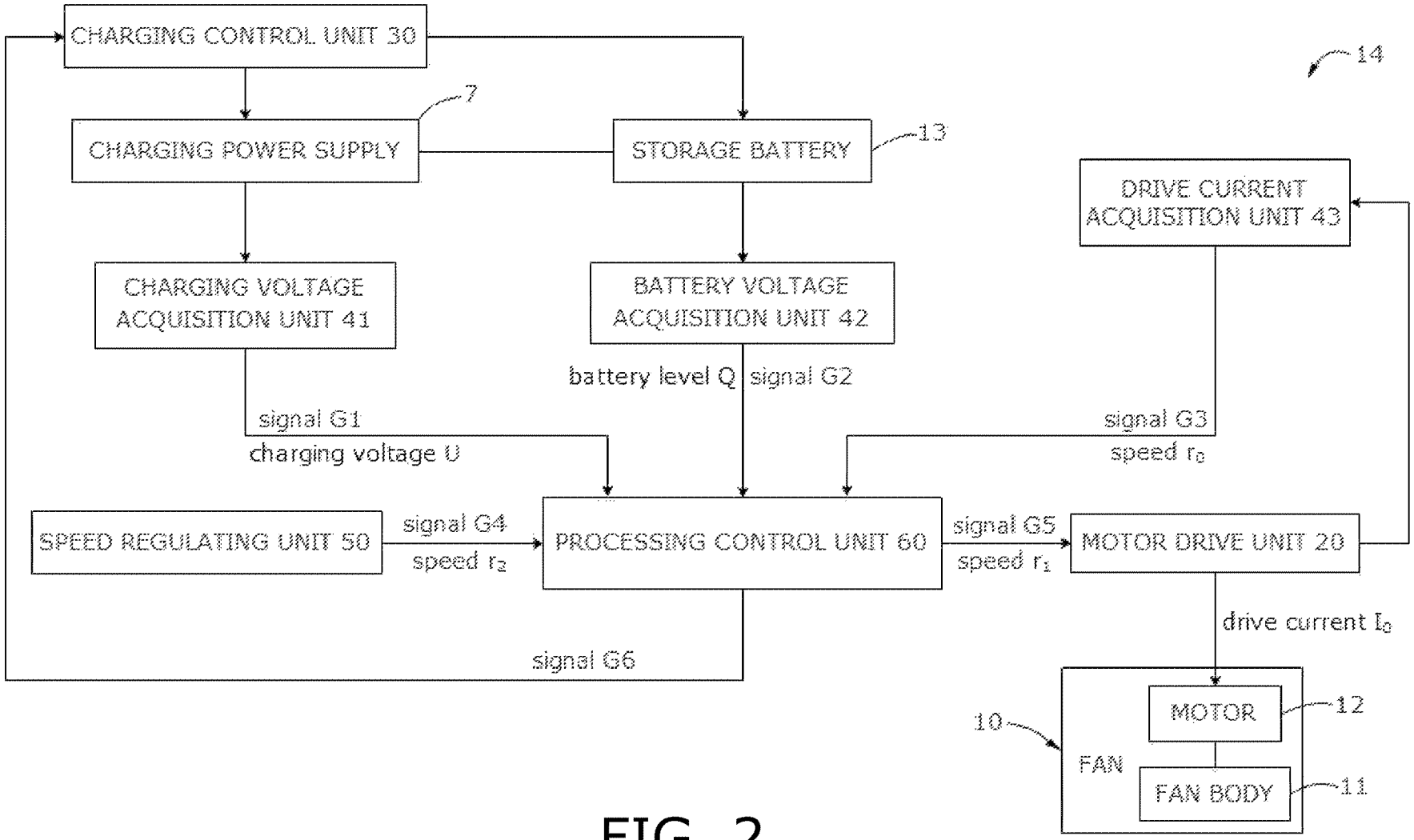
FIG. 2 is a circuit schematic diagram of a control circuit for a motor powered by a storage battery according to one or more embodiments.
Figure 3A:
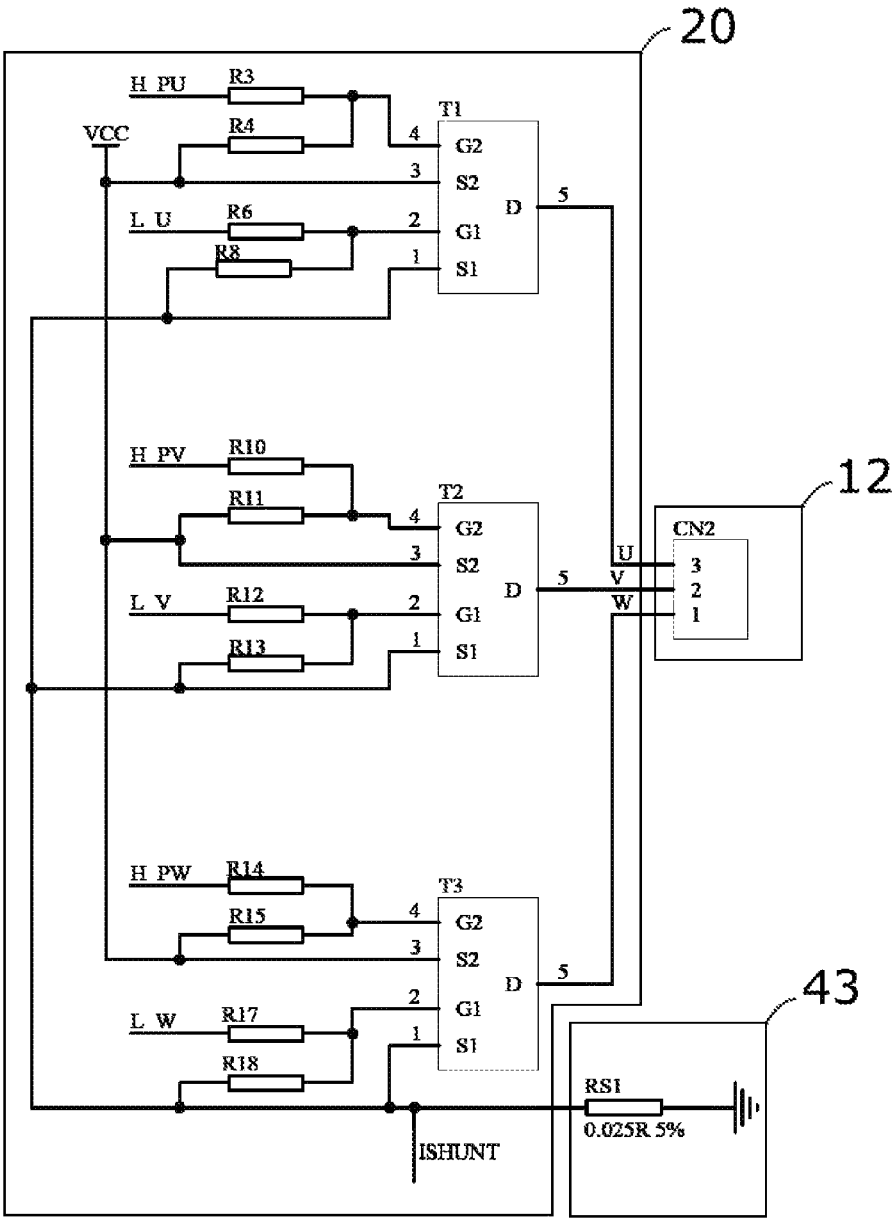
FIG. 3A is a circuit diagram showing the motor drive unit and the drive current acquisition unit of the control circuit in FIG. 2.
Figure 3B:
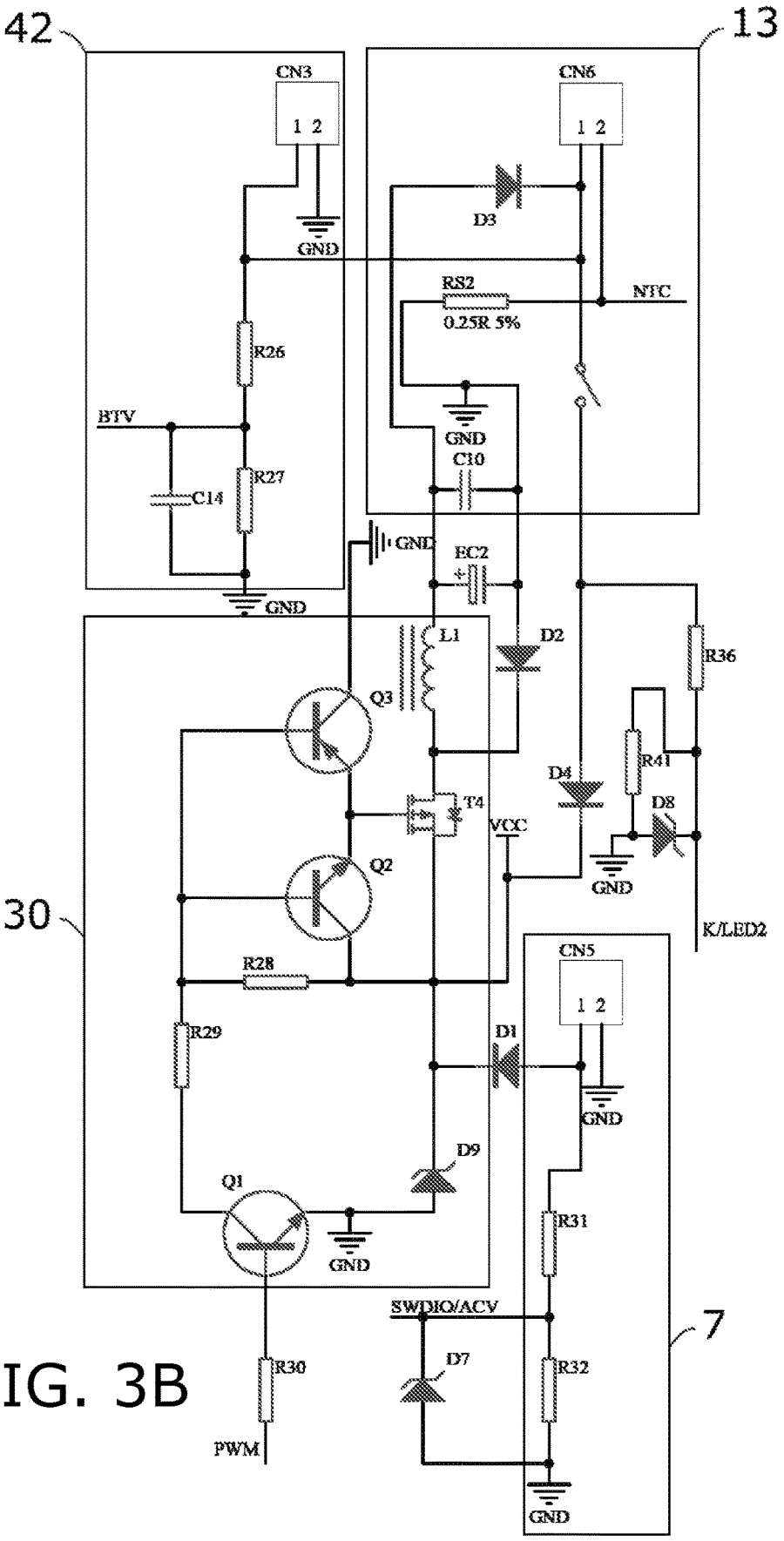
Figure 3C:
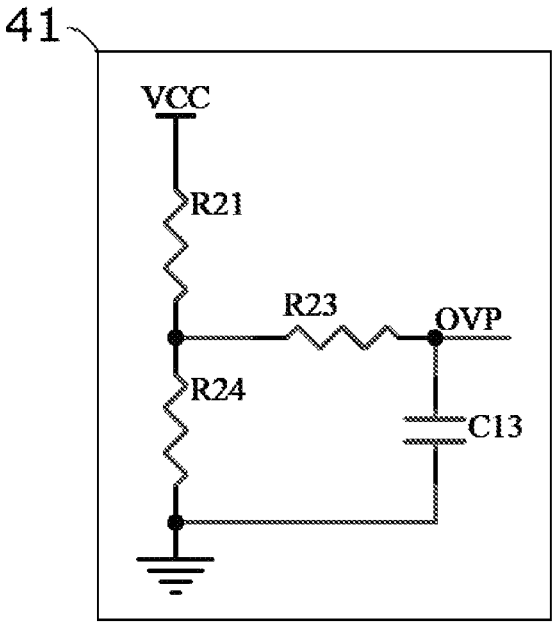
Figure 3D:
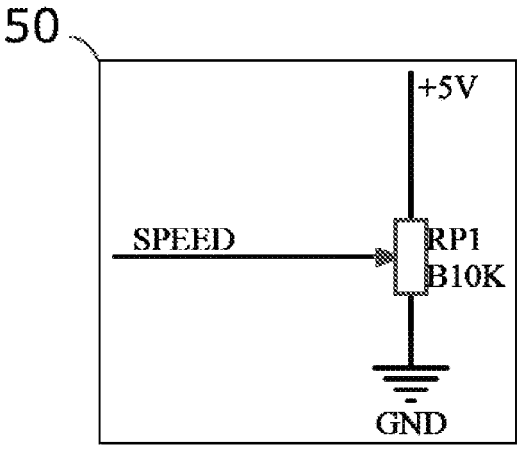
Figure 3E:
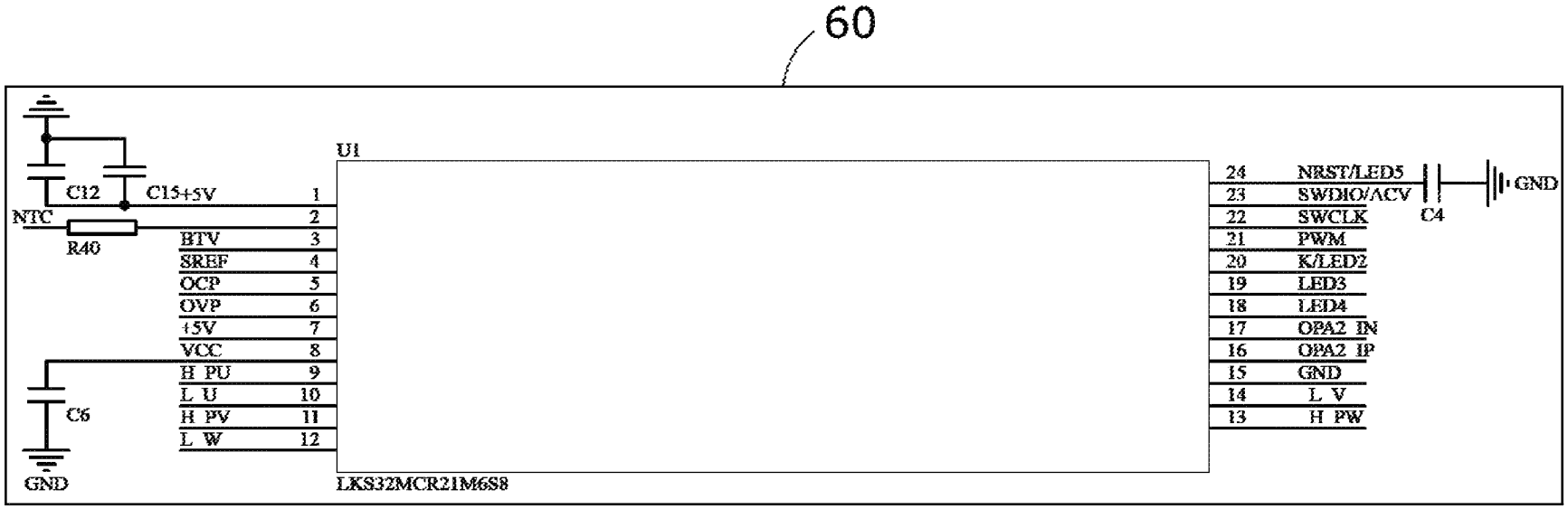
Figure 4:
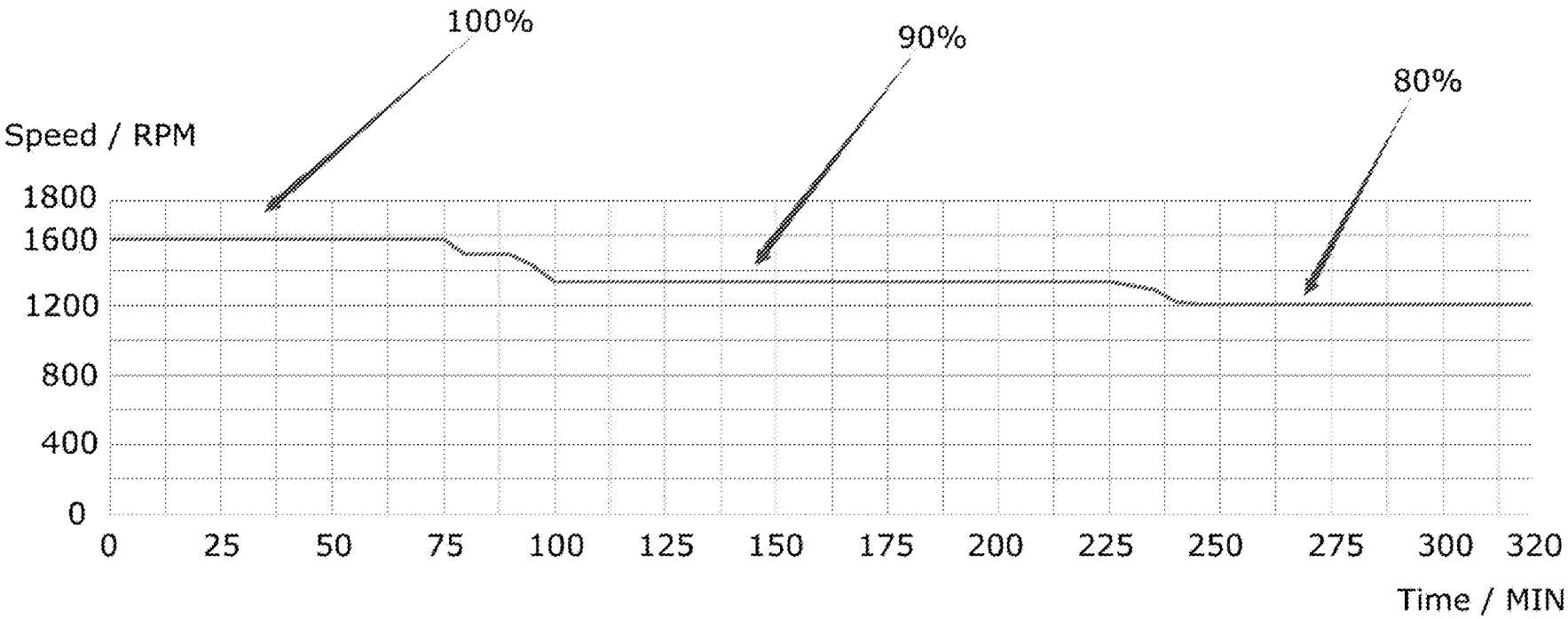

FIG. 3B a circuit diagram showing the charging control unit and the battery voltage acquisition unit of the control circuit in FIG. 2;

FIG. 3C a circuit diagram showing the charging voltage acquisition unit of the control circuit in FIG. 2;

FIG. 3D a circuit diagram showing the speed regulating unit of the control circuit in FIG. 2;

FIG. 3E a circuit diagram showing the processing control unit of the control circuit in FIG. 2; and FIG. 4 is a curve chart showing a relationship between rotating speed and service time of a fan according to one or more embodiments.

DETAILED DESCRIPTION

In the present disclosure, the drive current of the motor is adjusted based on the difference between the actual speed $r_0$ and the target speed $r_1$ of the motor, so that the actual speed $r_0$ can be controlled to approach the target speed $r_1$, which leads to no significant decreasing of the actual speed $r_0$ with the decrease of the battery level of the storage battery during the working process of the motor. Moreover, the target speed $r_1$ is also adjusted according to the battery level of the storage battery that when the battery level drops to a certain level, the target speed $r_1$ is lowered to reduce the load and consumption of the storage battery, so as to prolong the storage battery's endurance and service life. In this specification, "speed" of the motor refers to rotating speed. Following embodiments are used for illustration.

In one typical embodiment, a fan 10 includes a fan body 11, a motor 12, a storage battery 13, a control circuit 14 and a power display device, wherein the fan body 11 is driven by the motor 12 and the motor 12 is powered by the storage battery 13; the control circuit 14 controls the rotating speed of the motor 12; the power display device shows the battery level of the storage battery 13. The power display device may be a group of LEDs (LED is the abbreviation of "Light Emitting Diode"), and the battery level is indicated by the number of the LEDs turned on among the group of LEDs.

Referring to FIG. 2 and FIGS. 3A-3E, FIG. 2 is a circuit schematic diagram of the control circuit 14, and FIGS. 3A-3E are circuit diagrams showing each part of the control circuit 14. The control circuit 14 includes a motor drive unit 20, a charging control unit 30, a charging voltage acquisition unit 41, a battery voltage acquisition unit 42, a drive current acquisition unit 43, a speed regulating unit 50, and a processing control unit 60. The motor drive unit 20 drives the motor 12, the charging control unit 30 controls the charging status of the battery, and the charging voltage acquisition unit 41, the battery voltage acquisition unit 42, and the drive current acquisition unit 43 collect respective working signals of the motor 12, the battery, and the charging unit 30. The speed regulating unit 50 allows users to set the motor 12 with a standard speed $r_2$. According to output signals of the charging voltage acquisition unit 41, the battery voltage acquisition unit 42, the drive current acquisition unit 43 and the speed regulating unit 50, the processing control unit 60 controls input signals of the motor drive unit 20 and the charging control unit 30.

Specifically, the motor drive unit 20 outputs a drive current $I_0$ to drive the motor 12 to rotate according to a modulation signal G5 from the processing control unit 60, wherein the drive current $I_0$ may be a three-phase sine wave current. The actual speed $r_0$ of the motor 12 increases/decreases with the increase/decrease of the drive current $I_0$.

The storage battery 13 can be charged through a charging power supply 7 which can be an AC adapter (i.e., alternating current adapter). The charging voltage acquisition unit 41 collects the output voltage of the charging power supply 7, converts it into a charging voltage signal G1, and then transmits the charging voltage signal G1 to the processing control unit 60. The battery voltage acquisition unit 42 collects the output voltage of the storage battery 13, converts it into a battery voltage signal G2, and then transmits the battery voltage signal G2 to the processing control unit 60. The drive current acquisition unit 43 collects the drive current $I_0$, specifically the three-phase sine wave current mentioned above, of the motor drive unit 20, converts it into a drive current signal G3, and then transmits the drive current signal G3 to the processing control unit 60.

The speed regulating unit 50 is a speed controller that can be manipulated by a user. In an embodiment, the speed regulating unit 50 is a speed controller allowing stepless speed control of the motor 12. The standard speed $r_2$ of the motor 12 is set by the user through the speed regulating unit 50, which outputs a speed control signal G4 corresponding to the standard speed $r_2$ and transmits it to the processing control unit 60. Through the speed regulating unit, the user can set the motor's speed according to their own needs.

Based on the obtained output signals G1~G4 from the charging voltage acquisition unit 41, the battery voltage acquisition unit 42, the drive current acquisition unit 43 and the speed regulating unit 50, the processing control unit 60 computes and outputs signals that can control the motor drive unit 20 and the charging control unit 30. In some embodiments, the processing control unit 60 is a microprocessor, of which the processing and calculating includes:

Step 1: Calculate the charging voltage U of the charging power supply 7 according to the charging voltage signal G1, calculate the battery level Q of the storage battery 13 according to the battery voltage signal G2, calculate the actual speed $r_0$ of the motor 12 according to the drive current signal G3, and calculate the standard speed $r_2$ according to the speed control signal G4.

Step 2: Calculate the target speed $r_1$ according to the charging voltage U, the battery level Q and the standard speed $r_2$.

Step 3: Calculate the difference between the actual speed $r_0$ and the target speed $r_1$, and calculate a speed compensation amount P according to the difference. Inverse transform the speed compensation amount P to obtain a three-phase voltage. Convert the three-phase voltage into a three-phase sine wave signal G5, that is, the aforementioned modulation signal, by using the method of SVPWM (i.e., space vector pulse-width modulation), and transmit the three-phase sine wave signal G5 to the motor drive unit 20.

In Step 2, the relationship between the target speed r1 and the standard speed r2 is $r_1=a*r_2$, where the a is a proportional coefficient whose value decreases as the battery level Q of the storage battery 13 decreases. In some embodiments, the proportional coefficient a can be configured to linearly decrease with the decrease of the battery level Q of the storage battery 13. Alternatively, the proportional coefficient a can be configured to decrease step by step with the decrease of the battery level Q, for example, in some other embodiments, when the battery level Q is greater than 75% of the maximum capacity of the storage battery 13, the proportional coefficient a is 100%; when the battery level Q decreases to 75% or less of the maximum capacity of the storage battery 13, the proportional coefficient a decreases to 90%; when the battery level Q continues to decrease to 25% or less of the maximum capacity of the storage battery 13, the proportion coefficient a decreases to 80%. When the battery level of the storage battery decreases, appropriately reducing the rotating speed of the motor can reduce the load of the storage battery, so as to prolong the storage battery's endurance and service life. This is because when the battery level drops, if the motor continues to work at a higher speed, the storage battery will be required to continue to provide a larger discharge current, which will lead to a faster decline in the battery level and deteriorate the battery's endurance. Moreover, if the storage battery is in a fully discharged or half-discharged state for a long time, it will cause excessive damage to the storage battery, thus shortening the battery's service life.

In addition, the value of the proportional coefficient a can also be related to the charging voltage U. When the charging voltage U is equal to the rated charging voltage of the storage battery 13, the proportional coefficient a is a constant value. To further protect the storage battery 13, when the battery level Q is less than an ultra-low threshold, even if the charging voltage U is equal to the rated charging voltage of the storage battery 13, the proportional coefficient a is still reduced until the discharge speed of the storage battery 13 is less than the charging speed. Adjusting the motor's speed according to the charging state of the storage battery can make the storage battery not suffer loss under low battery power when the motor recovers to a higher speed.

In Step 3, the speed compensation amount P can be calculated via a PI (proportional-integral) regulator. The speed compensation amount P is proportional to the difference between the actual speed $r_0$ and the target speed $r_1$. When the difference is not zero, the speed compensation amount P changes towards making the difference zeroed. The three-phase sine wave signal G5 is a PWM (Pulse-Width Modulation) signal, whose duty cycle is controlled by the speed compensation amount P, and the relationship between the speed compensation amount P and the aforementioned difference is as follows: when the actual speed $r_0$ is lower than the target speed $r_1$, the speed compensation amount P will increase the duty cycle of the three-phase sine wave signal G5; when the actual speed $r_0$ is higher than the target speed $r_1$, the speed compensation amount P will reduce the duty cycle of the three-phase sine wave signal G5. The three-phase sine wave signal G5, that is, the control signal of the motor drive unit 20, is used to modulate the magnitude of the three-phase sine wave current by changing its duty cycle: when the duty cycle of the three-phase sine wave signal G5 increases, the three-phase sine wave current increases accordingly, so as to increase the actual speed $r_0$ of the motor 12; when the duty cycle of the three-phase sine wave signal G5 decreases, the three-phase sine wave current decreases accordingly, thereby reducing the actual speed $r_0$ of the motor 12.

In addition, the processing control unit 60 of the control circuit 14 also controls the charging unit 30, which calculates according to the battery level Q and outputs a charging control signal G6 to the charging control unit 30. When the battery level Q reaches the maximum capacity of the storage battery 13, the charging control signal G6 is a command to suspend charging; when the battery level Q is lower than the maximum capacity of the storage battery 13, the charging control signal G6 is a command to allow charging.

The charging control unit 30 controls the charging state of the storage battery 13 according to the charging voltage output from the charging power supply 7 and the charging control signal G6 from the processing control unit 60: when the charging voltage does not reach the rated charging voltage of the storage battery 13, the charging control unit 30 will cut off the charging current to stop charging; also, when the charging control signal G6 is the command to suspend charging, the charging control unit 30 will cut off the current from the charging power supply 7 to the storage battery 13; conversely, when the charging control signal G6 is the command to allow charging, the charging control unit 30 will electrically connect the charging power supply 7 to the storage battery 13.

During the period of using the fan 10 with sufficient battery power, the user can make the speed setting through the speed regulating unit 50 of the control circuit 14, and the speed regulating unit 50 outputs a speed control signal G4 according to the setting, the processing control unit 60 calculates the standard speed $r_2$ based on the speed control signal G4 and sets the target speed $r_1$ equal to the standard speed $r_2$, and then compares the actual speed $r_0$ and the target speed $r_1$. When a non-zero difference between the two occurs, a three-phase sine wave signal G5 is generated to adjust the three-phase sine wave current output by the motor drive unit 20, and thereby adjust the actual speed $r_0$ of the motor 12 to be equal to the target speed $r_1$. Meanwhile, the control circuit 14 also detects the battery level Q and the charging voltage U of the storage battery 13 in real time, as the battery level drops with the use of the fan 10. When the battery level Q decreases below a threshold and the charging voltage U is not equal to the rated charging voltage of the storage battery 13, the processing control unit 60 lowers the target speed $r_1$ to reduce the discharge speed of the storage battery 13 at the low battery level.

Figure 1:
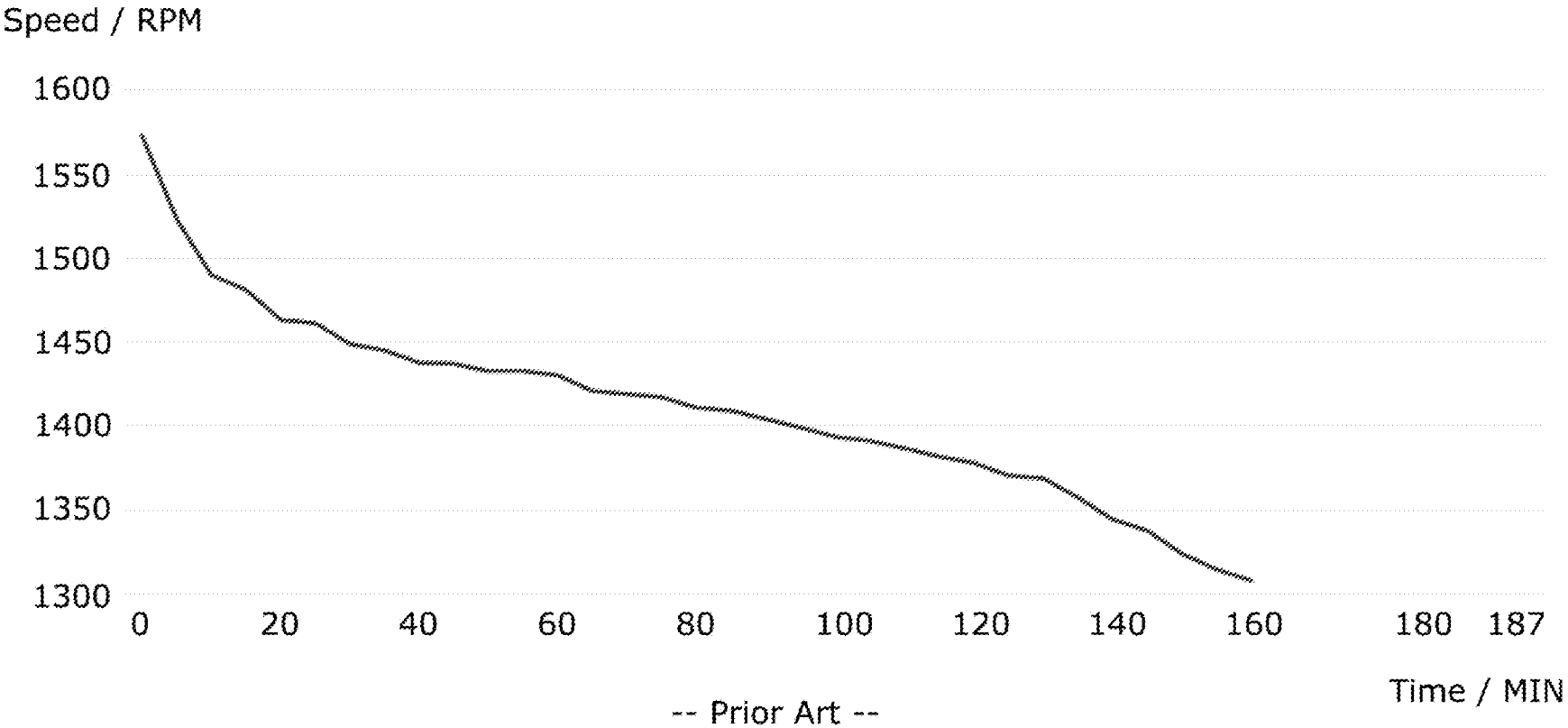
FIG. 1 is a curve chart showing a relationship between rotating speed and service time of a fan powered by a storage battery in the conventional art.

Compared with the known art, the fan powered by the storage battery of the present disclosure can maintain a stable rotating speed of the motor, even when the battery level drops, so that the wind speed of the fan can remain stable. Furthermore, the rotating speed of the motor is adjusted in stages according to the battery level, so that the storage battery of the fan has a stronger endurance and a longer service life. Please refer to FIG. 4, which is a curve chart showing the relationship between the motor's speed and the service time in one embodiment of the present disclosure. Comparing the curve in FIG. 4 with the curve in FIG. 1 showing the relationship between the motor's speed and the service time in the conventional art, it shows that in a relatively long time interval, the speed of the motor of this embodiment can maintain stable, and the rotating speed of the fan of this embodiment decreases step by step as the battery level decreases, which indicates that the storage battery of this embodiment has a stronger endurance capability.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality.

What is claimed:

1. A control circuit for a motor powered by a storage battery, comprising:

a motor drive unit, configured to provide a drive current for the motor according to a modulation signal;

a processing control unit, configured to obtain an actual speed $r_0$ of the motor, calculate the modulation signal according to a difference between the actual speed $r_0$ and a target speed $r_1$, and transmit the modulation signal to the motor drive unit; and wherein the modulation signal is used to control rotation of the motor by modulating the drive current to make the difference tend to zero.

2. The control circuit of claim 1, wherein the modulation signal is a three-phase sine wave signal, and when the actual speed $r_0$ is higher than the target speed $r_1$, a duty cycle of the modulation signal decreases; when the actual speed $r_0$ is lower than the target speed $r_1$, the duty cycle of the modulation signal increases.

3. The control circuit of claim 1, wherein the processing control unit is configured to obtain a battery level Q of the storage battery, adjust the target speed $r_1$ according to the battery level Q, so that the target speed $r_1$ decreases correspondingly with a decrease of the battery level Q.

4. The control circuit of claim 3, further comprising:

a speed regulating unit, configured to allow a user to set a standard speed $r_2$, and output the standard speed $r_2$ to the processing control unit; and wherein the processing control unit is configured to determine a proportional coefficient a according to the battery level Q, wherein the coefficient a decreases accordingly with the decrease of the battery level Q, and the target speed $r_1$ and the standard speed $r_2$ have a relationship: $r_1=a*r_2$.

5. The control circuit of claim 4, wherein the processing control unit is configured to obtain a charging voltage U of the storage battery; wherein the coefficient a is a constant value under one of the following conditions: (a) the charging voltage U is equal to a rated charging voltage of the storage battery; (b) the charging voltage U is equal to the rated charging voltage and the battery level Q is higher than a threshold.

6. The control circuit of claim 2, wherein the processing control unit is configured to obtain a battery level Q of the storage battery, adjust the target speed $r_1$ according to the battery level Q, so that the target speed $r_1$ decreases correspondingly with a decrease of the battery level Q.

7. The control circuit of claim 6, further comprising:

a speed regulating unit, configured to allow a user to set a standard speed $r_2$, and output the standard speed $r_2$ to the processing control unit; and wherein the processing control unit is configured to determine a proportional coefficient a according to the battery level Q, wherein the coefficient a decreases accordingly with the decrease of the battery level Q, and the target speed $r_1$ and the standard speed $r_2$ have a relationship: $r_1=a*r_2$.

8. The control circuit of claim 7, wherein the processing control unit is configured to obtain a charging voltage U of the storage battery; wherein the coefficient a is a constant value under one of the following conditions: (a) the charging voltage U is equal to a rated charging voltage of the storage battery; (b) the charging voltage U is equal to the rated charging voltage and the battery level Q is higher than a threshold.

9. The control circuit of claim 1, wherein the motor is used for driving a fan to work.

10. The control circuit of claim 2, wherein the motor is used for driving a fan to work.

11. A fan, comprising:

a fan body;

a storage battery;

a motor for driving the fan body, powered by the storage battery; and a control circuit for the motor, comprising:

a motor drive unit, configured to provide a drive current for the motor according to a modulation signal;

a processing control unit, configured to obtain an actual speed $r_0$ of the motor, calculate the modulation signal according to a difference between the actual speed $r_0$ and a target speed $r_1$, and transmit the modulation signal to the motor drive unit; and wherein the modulation signal is used to control rotation of the motor by modulating the drive current to make the difference tend to zero.

12. The fan of claim 11, wherein the modulation signal is a three-phase sine wave signal, and when the actual speed $r_0$ is higher than the target speed $r_1$, a duty cycle of the modulation signal decreases; when the actual speed $r_0$ is lower than the target speed $r_1$, the duty cycle of the modulation signal increases.

13. The fan of claim 11, wherein the processing control unit is configured to obtain a battery level Q of the storage battery, adjust the target speed $r_1$ according to the battery level Q, so that the target speed $r_1$ decreases correspondingly with a decrease of the battery level Q.

14. The fan of claim 13, wherein the control circuit further comprises:

a speed regulating unit, configured to allow a user to set a standard speed $r_2$, and output the standard speed $r_2$ to the processing control unit; and wherein the processing control unit is configured to determine a proportional coefficient a according to the battery level Q, wherein the coefficient a decreases accordingly with the decrease of the battery level Q, and the target speed $r_1$ and the standard speed $r_2$ have a relationship: $r_1=a*r_2$.

15. The fan of claim 14, wherein the processing control unit is configured to obtain a charging voltage U of the storage battery; wherein the coefficient a is a constant value under one of the following conditions: (a) the charging voltage U is equal to a rated charging voltage of the storage battery; (b) the charging voltage U is equal to the rated charging voltage and the battery level Q is higher than a threshold.

16. The fan of claim 12, wherein the processing control unit is configured to obtain a battery level Q of the storage battery, adjust the target speed $r_1$ according to the battery level Q, so that the target speed $r_1$ decreases correspondingly with a decrease of the battery level Q.

17. The fan of claim 16, wherein the control circuit further comprises:

a speed regulating unit, configured to allow a user to set a standard speed $r_2$, and output the standard speed $r_2$ to the processing control unit; and wherein the processing control unit is configured to determine a proportional coefficient a according to the battery level Q, wherein the coefficient a decreases accordingly with the decrease of the battery level Q, and the target speed $r_1$ and the standard speed $r_2$ have a relationship: $r_1=a*r_2$.

18. The fan of claim 17, wherein the processing control unit is configured to obtain a charging voltage U of the storage battery; wherein the coefficient a is a constant value under one of the following conditions: (a) the charging voltage U is equal to a rated charging voltage of the storage battery; (b) the charging voltage U is equal to the rated charging voltage and the battery level Q is higher than a threshold.

* * * * *